United States Patent [19]

Koch

[11] Patent Number: 4,478,258

[45] Date of Patent: Oct. 23, 1984

[54] WARP STOP MOTION DEVICE OF A WEAVING MACHINE

[75] Inventor: Bernhard Koch, Horgenberg, Switzerland

[73] Assignee: Grob & Co. Aktiengesellschaft, Horgen, Switzerland

[21] Appl. No.: 426,654

[22] Filed: Sep. 29, 1982

[30] Foreign Application Priority Data

Dec. 11, 1981 [DE] Fed. Rep. of Germany ..... 3149219

[51] Int. Cl.[3] ..... D03D 51/30

[52] U.S. Cl. ..... 139/358; 139/369; 242/157 R

[58] Field of Search ..... 139/92, 358, 369; 28/187; 242/157 R; 66/125

[56] References Cited

U.S. PATENT DOCUMENTS

| | | | |
|---|---|---|---|
| 1,758,604 | 5/1930 | Houghton | 242/157 R |
| 2,768,799 | 10/1956 | Porter et al. | 242/157 R |
| 2,896,434 | 7/1959 | McKinley et al. | 242/157 R |

*Primary Examiner*—Henry Jaudon

*Attorney, Agent, or Firm*—Watson, Cole, Grindle & Watson

[57] ABSTRACT

In a weaving machine having a warp stop motion feature which includes upper and lower vertically aligned supports for supporting contact bars and guide bars, the lower support being cantilevered to a longitudinal beam, the warp ends extending parallel to the upper supports and through eyelets provided in drop wires resting on the warp ends which are carried by an upper surface of the beam. The beam comprises a hollow body having a wear resistant element mounted along an upper side thereof, the element being replaceable and being of a material harder than the beam itself.

2 Claims, 3 Drawing Figures

Fig. 1
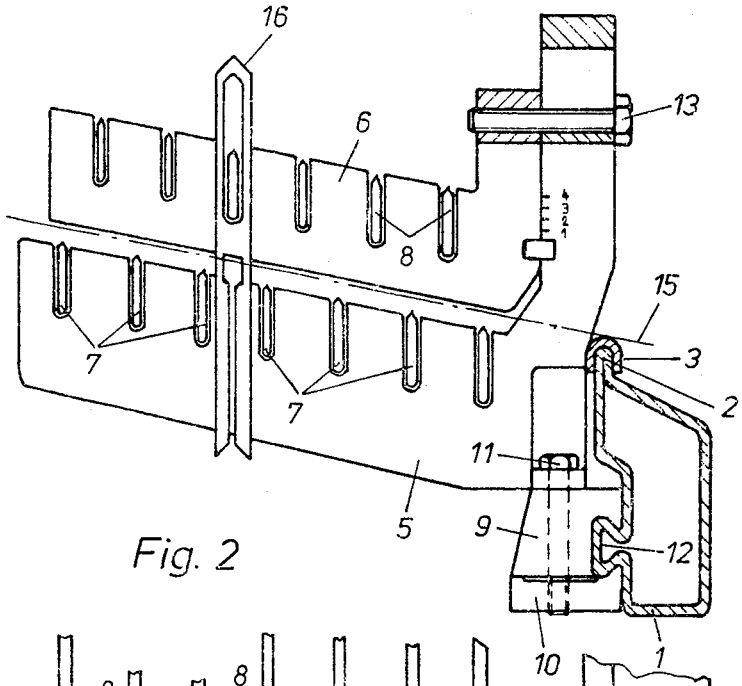
Fig. 2
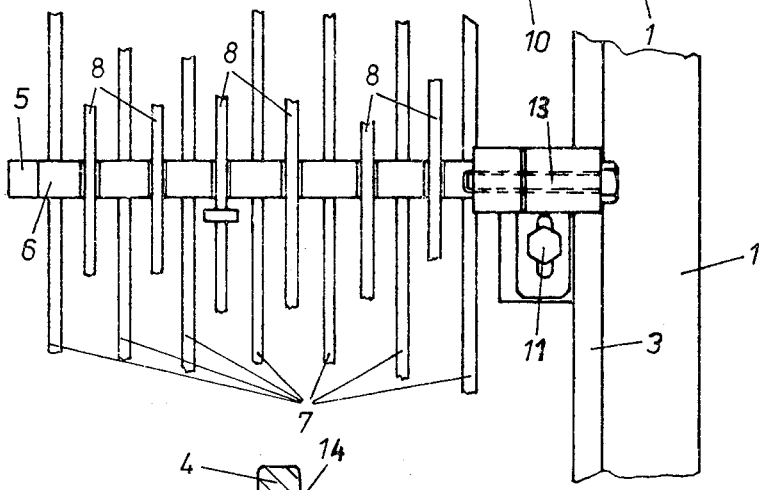
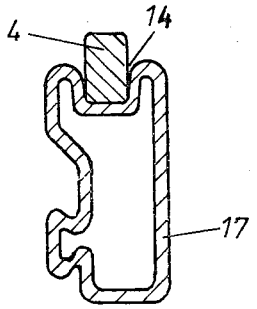
Fig. 3

WARP STOP MOTION DEVICE OF A WEAVING MACHINE

RELATED APPLICATION

This application relates to U.S. Ser. No. 426,660, filed Sept. 29, 1982, claiming priority based on German Appl. P 31 49 235.5 of Dec. 11, 1981, and commonly owned herewith.

BACKGROUND OF THE INVENTION

This invention relates to a warp stop motion feature of a weaving machine having at least one longitudinal beam and perpendicularly related contact bar and guide bar supports, the latter supporting a plurality of serrated bars.

On existing warp stop motion devices of weaving machines, the longitudinal beam, on which bar supports are mounted for supporting contact and guide bars, renders the assembly quite stable, and the longitudinal beam likewise serves as a thread supporting element. All the warp ends pass over the longitudinal beam, which is perpendicularly arranged relative thereto. The warp stop motion device has either one or two longitudinal beams transversely interconnected between their ends to form a rectangular frame.

Otherwise, a single beam is provided on which the bar supports are cantilevered as in accordance with the aforementioned related application.

In the region of the warp stop motion, drop wires rest on the warp ends as in the normal manner. The longitudinal beam, which is also known as a thread supporting tube, is therefore subject to wear, so that existing longitudinal beams must either be nickel-plated or chrome-plated to increase the hardness and wear resistance. Since the beams render the framework essentially stable, they must have a relatively large cross-section so that its entire outer surface must be chrome- or nickel-plated to render it wear resistant. This, however, is quite uneconomical to fabricate and to replace after normal wear. Also, the longitudinal beam has in the past been formed as an oval tube having a flat bottom with a large rounded upper side contacted by the warp ends. Such a tube likewise had to be completely surface treated.

SUMMARY OF THE INVENTION

These drawbacks are avoided by the present invention which provides a longitudinal beam for the aforedescribed purpose but which is more economical to manufacture and which has a replaceable wear resistant element thereby reducing the cost of operation and maintenance. The remaining portion of the beam need not therefore be wear resistant and may be untreated, thus producing savings in materials and labor.

The longitudinal beam may be in the form of a hollow body having an upper longitudinal rib on which a cap-shaped wear-resistant element is seated. Or, the beam may be in the form of a hollow body construction having a longitudinal groove along its upper side for the reception of a solid elongated block of wear-resistant material. In any case, the outer surface of this element may be of a chrome- or nickel-plated material or be made of a highly polished and tempered steel.

BRIEF DESCRIPTION OF THE DRAWINGS

FIG. 1 is a cross-sectional view of the longitudinal beam to which upper and lower supports for the contact and guide bars of a warp stop motion are mounted;

FIG. 2 is a plan view of the arrangement of FIG. 1; and

FIG. 3 is a cross-sectional view of another embodiment of a longitudinal beam and wear element according to the invention.

DETAILED DESCRIPTION OF THE INVENTION

Turning now to the drawings wherein like reference characters refer to like and corresponding parts throughout the several views, FIGS. 1 and 2 are essentially the same as FIGS. 1 and 3 of the aforementioned related application, and the bar support arrangement functions precisely the same. The warp stop motion device associated with the weaving machine of the invention has a single longitudinal beam 1 comprising a hollow-profile body. The beam has a vertically extending rib 2 provided along its entire upper side between opposite ends of the beam which is supported in the normal manner. This rib is formed by crimping or the like, and a wear resistant element in the form of an elongated cap 3 is mounted on rib 2 in such a manner that it can be removed and replaced when worn. For example, the cap may be mounted by means of threaded fasteners (not shown), by a suitable adhesive, or by other suitable means. Element 3 has at least its outer surface nickel- or chrome-plated, or may be comprised of hardened or polished steel. Thus, the beam, which is much larger, need not be surface treated and can be fabricated of material designed only to provide the necessary stability for the assembly. Thus, beam 1 serves as a structure to which support 5 is cantilevered at one end. Support 6 is, at one end, cantilevered to the one end of support 5, and supports 5 and 6 respectively support guide bars 7 and contact bars 8. Lower support 5 is mounted to the beam by means of cooperating clamps 9 and 10 through which a bolt 11 extends. The clamps are recessed for embracing a longitudinal projection 12 of the beam. And, a bolt extends through vertical legs 5 and 6 of the supports for locking them in an adjusted position as described in more detail in the aforementioned related application. Warp ends 15 pass over the protection cap 3 through eyelets provided in drop wires 16 which rest on the warp ends.

In another embodiment, a beam 17 shown in FIG. 3 likewise has a hollow profile, but is instead provided at its upper side with a longitudinally extending groove 14. The wear resistant element is in the form of a solid elongated bar 4 received within this groove and which may be attached thereto in any normal manner, as by adhesive. This bar is likewise made removable and replaceable so that, when worn, the beam itself may need not be replaced and may be fabricated of less-expensive material.

Obviously, many modifications and variations of the present invention are made possible in the light of the above teachings. It is therefore to be understood that within the scope of the appended claims the invention may be practiced than otherwise as specifically described.

What is claimed is:

1. In a weaving machine having a warp stop motion device which includes upper and lower vertically aligned supports for respectively supporting contact bars and guide bars lying perpendicular thereto, drop wires guided on said contact bars and between adjacent pairs of said guide bars, warp ends extending parallel to upper supports and through eyelets provided in said drop wires, a longitudinal beam which functions as a structure on which the supports are mounted, said beam lying perpendicular to said supports and parallel to said bars, said beam also functions as a contact support for the warp ends, the improvement wherein said beam comprises a hollow body having along one side a horizontally extending dovetailed portion to which one of said supports is cantilever mounted by means of cooperating clamps, said beam further having along its upper side a vertically extending crimped portion about which a wear resistant element is removably mounted entirely between opposite ends of said beam, said element solely defining said contact support and being of a material having a hardness greater than the hardness of the material of the beam.

2. In the weaving machine according to claim 1, wherein said element has an outer surface comprised of one of a chromium-plated, nickel-plated and hardened, highly polished steel material.

* * * * *